US009697808B1

(12) United States Patent
Sanzo et al.

(10) Patent No.: US 9,697,808 B1
(45) **Date of Patent: *Jul. 4, 2017**

(54) STRINGED MUSICAL INSTRUMENT WITH ROTATING NECK

(71) Applicants: Christopher J. Sanzo, Providence, RI (US); Mel Waldorf, Alameda, CA (US)

(72) Inventors: Christopher J. Sanzo, Providence, RI (US); Mel Waldorf, Alameda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/998,066

(22) Filed: Dec. 24, 2015

Related U.S. Application Data

(63) Continuation-in-part of application No. 14/551,124, filed on Nov. 24, 2014, now Pat. No. 9,224,370.

(51) Int. Cl.
*G10D 1/08* (2006.01)
*G10D 3/06* (2006.01)
*G10D 3/04* (2006.01)

(52) U.S. Cl.
CPC ..... *G10D 3/06* (2013.01); *G10D 1/085* (2013.01); *G10D 3/04* (2013.01)

(58) Field of Classification Search
CPC ..... G10D 3/06; G10D 1/085; G10D 3/04
USPC ..... 84/267, 293
See application file for complete search history.

(56) References Cited

U.S. PATENT DOCUMENTS

| | | | | |
|---|---|---|---|---|
| 4,111,093 | A * | 9/1978 | Field | G10D 3/06 84/267 |
| 4,191,085 | A * | 3/1980 | Litwin | G10D 3/06 84/291 |
| 5,353,672 | A | 10/1994 | Stewart | |
| 6,353,164 | B1 * | 3/2002 | Corsi | G10D 3/06 84/290 |
| 6,956,157 | B2 | 10/2005 | Strobel | |
| 7,365,254 | B2 | 4/2008 | Johansson | |
| 7,781,654 | B1 * | 8/2010 | Kamensky | G10D 1/00 84/267 |
| 7,816,592 | B2 * | 10/2010 | Babicz | G10D 3/06 84/267 |
| 8,203,058 | B2 | 6/2012 | Leach | |
| 8,273,974 | B1 * | 9/2012 | Gonzalez | G10D 1/085 84/267 |

* cited by examiner

*Primary Examiner* — Jianchun Qin
(74) *Attorney, Agent, or Firm* — Chace Ruttenberg & Freedman, LLP

(57) ABSTRACT

Provided is a foldable stringed having a rotating neck in which the fret board in the folded position is opposite the rear face and the mechanism employs a flexible cable system under variable tension.

20 Claims, 8 Drawing Sheets

FIG. 6A
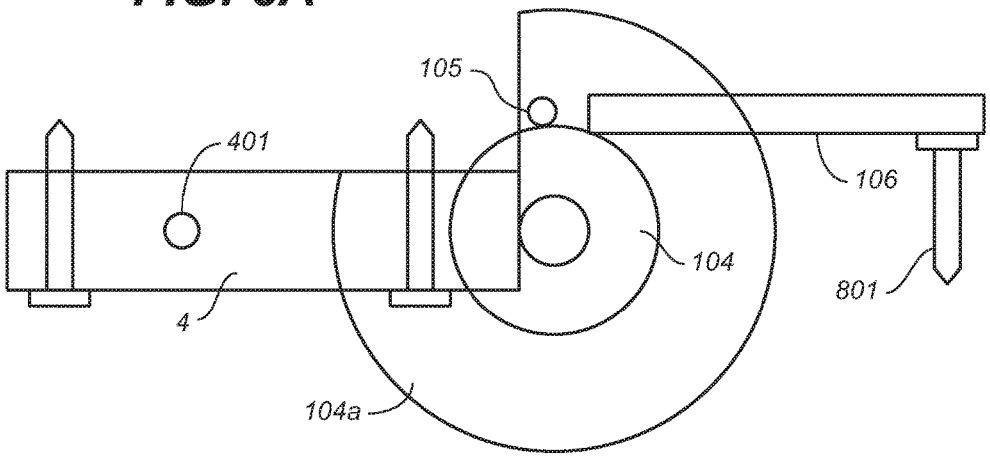
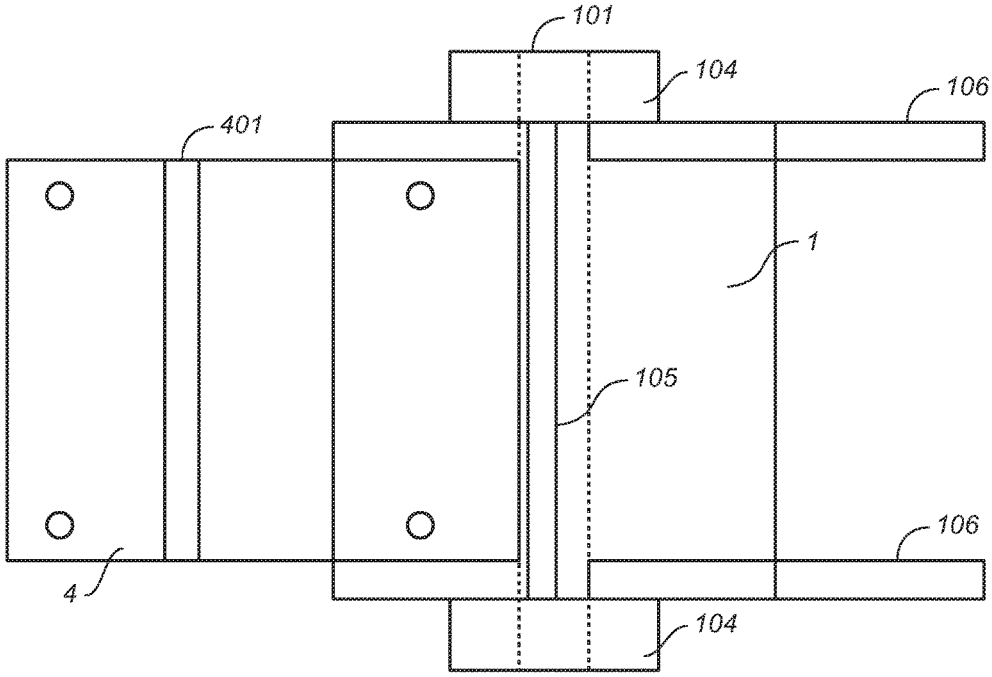
FIG. 6B

FIG. 7A
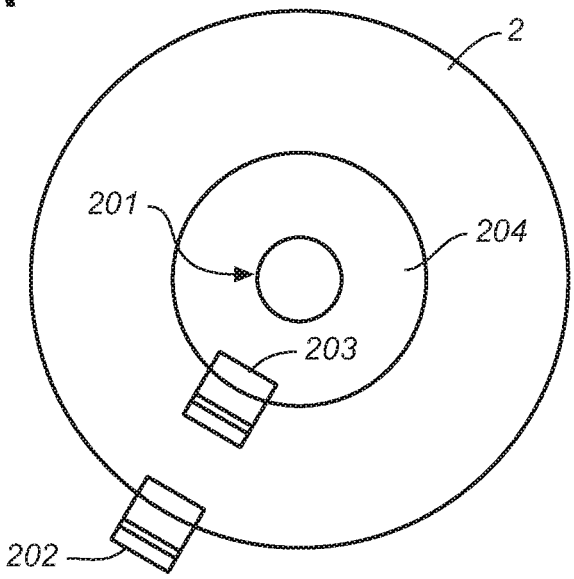
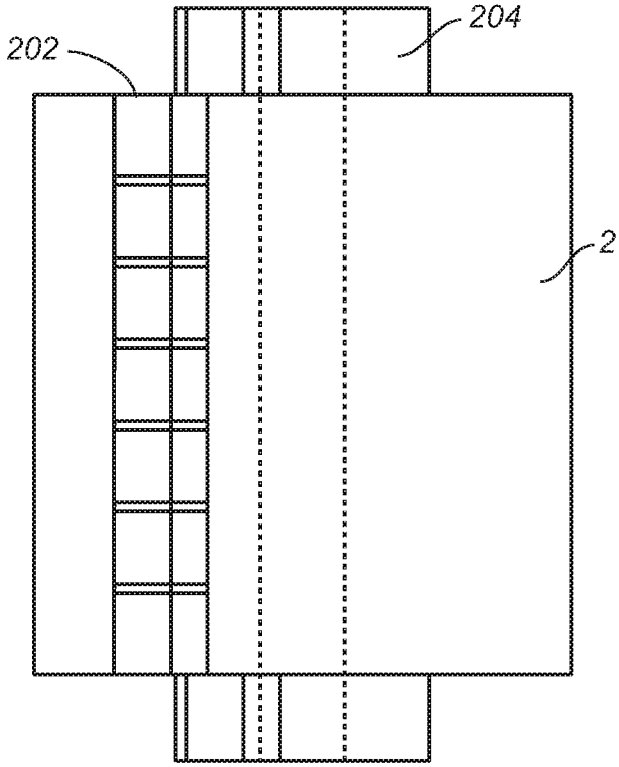
FIG. 7B

STRINGED MUSICAL INSTRUMENT WITH ROTATING NECK

REFERENCE TO RELATED APPLICATIONS

This application is a continuation-in-part of U.S. Ser. No. 14/551,124 filed Nov. 24, 2014 (now U.S. Pat. No. 9,224,370) and claims priority thereto. The disclosure of U.S. Pat. No. 9,224,370 is herein incorporated by reference.

FIELD OF THE INVENTION

The invention relates to stringed musical instruments. In particular, the invention relates to stringed musical instruments that are more manageable for traveling.

BACKGROUND OF THE INVENTION

The construction of stringed musical instruments has been around for a long, long time, and they have evolved to the point where we take for granted a standard arrangement of common elements. For example, most non-electric stringed musical instruments have a headstock, tuners (geared assemblies for applying tension to strings), a neck, strings, and a body. For electric stringed musical instruments, pickups with associated electronics and, perhaps, a vibrato bar are common additional elements. Further, guitar players like fairly standard dimensions from the nut (the string vibration terminus at the neck) to the bridge (the string vibration terminus at the body) of between 24.75 and 25.5 inches. In short, musicians do not want instruments that have odd arrangements of elements and most certainly do not want those elements dismantled. They like what they are used to, with modest differences in preference to style and performance.

Today, guitars and basses are approximately 36 inches to 48 inches long from the top of the headstock to the end of the body. This length creates difficulties for transport, and with the delicate neck consuming about three-quarters of this length, many solutions involve detaching the neck or "hinging" the neck. For example, U.S. Pat. Nos. 4,191,085, 5,353,672, and 6,956,157 describe clips and clamps and other machinations for removing the neck from the body of the guitar for ease of transport. Unfortunately, once the neck is removed, the strings flop, bend, and kink. The instrument's intonation can be radically disturbed and, lastly, wood under tension settle—much like a house settles. In a worst case scenario, the neck can warp. U.S. Pat. No. 8,203,058 describes hinging the neck onto the body and dropping the fret board onto the face of the guitar during travel. Here, the top of the guitar can be marred by the neck flopping on top of it, and the fret board can be marred by an errant string peg or sharp bridge assembly. Further, as noted above, with the neck released from tension, the strings flop, bend, and kink. U.S. Pat. No. 7,365,254 also describes hinging the neck, but when the fret board is dropped onto the face of the guitar a spring-loaded roller takes up the slack of the strings. Once again, the top of the guitar and the fret board can be marred. Further, in the process of rolling up the strings, the strings can crisscross and kink, and the tension of the strings on the roller during transit is not controlled relative to the tension of the strings while playing.

U.S. Pat. No. 4,111,093 describes an instrument with a rotating neck wherein the fret board in the folded position is opposite the rear face and the mechanism employs a rack and pinion roller coupling system, resulting in rigid rotational having a fixed tension.

BRIEF DESCRIPTION OF THE DRAWINGS

FIGS. 6*a* and 6*b* are side and top views of another embodiment of the invention in the unfolded 'playing' state.

FIGS. 7*a* and 7*b* are side and top views of a further embodiment of the invention in the unfolded 'playing' state.

DETAILED DESCRIPTION OF THE INVENTION

Figure 1:
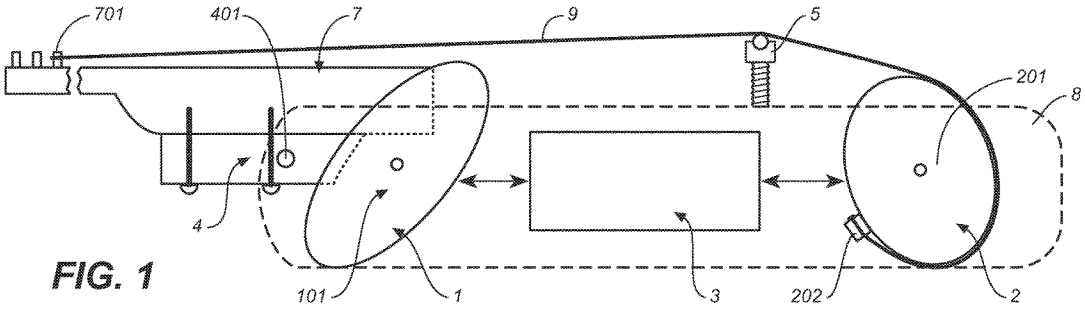
FIG. 1 is a side view of one embodiment of the invention in the unfolded 'playing' state.

The present invention is manufactured with al 11 the standard processes available for stringed musical instruments. For example, as shown in FIG. 1, neck and fret board assembly 7 are mounted to neck roller assembly 1 using neck mount 4. Neck mount 4 is substantially the same as, if not exactly the same as, any four-screw, bolt-on-neck arrangement. In contrast, bridge roller assembly 2 replaces the standard stud mount, trapeze or vibrato tailpiece.

Figure 2:
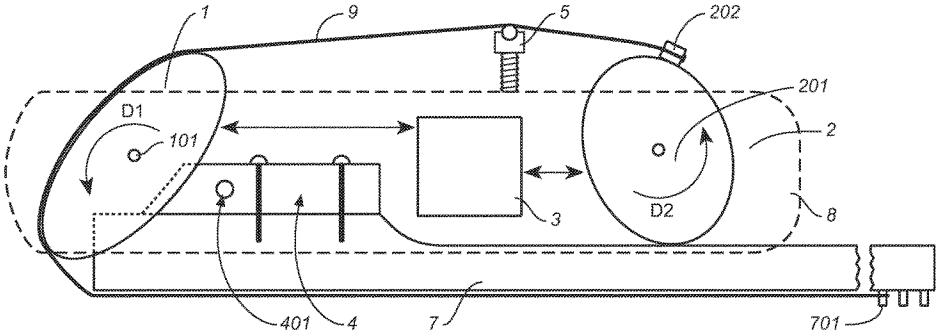
FIG. 2 is a side view of the same embodiment of the instrument in the folded 'in-transit' state.

In FIGS. 1 and 2, one embodiment of the invention is shown in both its unfolded 'playing' state and its folded 'in-transit' state, respectively. In particular, when the neck moves from an unfolded, operative, position to a folded position, strings 9 remain under tension by the anchoring between anchor points 202 and 701 over bridge element 5, and the strings will, in turn, wrap around the neck roller assembly.

Strings 9 remain under tension because the length of string required to wrap around neck roller assembly 1 comes from a reservoir of string controlled in bridge roller assembly. In other words, string tension is maintained by coupling neck roller assembly 1 to bridge roller assembly 2 via the coupling system. Thus, the string tension in the folded position may be the same as, or different from, the string tension in the unfolded position.

When in a folded position, and as shown in FIG. 2, the neck is resting against the back of the stringed musical instrument. In an alternative embodiment, the neck sits within a cavity in the back of the instrument. In this embodiment, the neck may sit partially within the opening (that is, not flush with the back of the guitar), or fully within the opening (that is, flush with the back of the guitar).

Figure 3A:
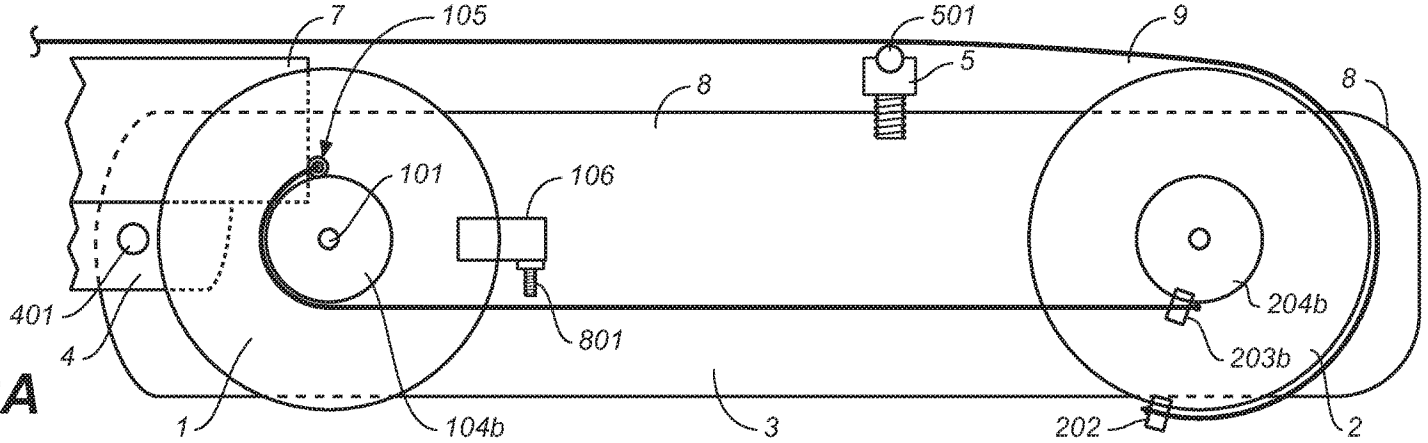
FIGS. 3*a* and 3*b* are side and top views of another embodiment of the invention in the unfolded 'playing' state.
Figure 3B:
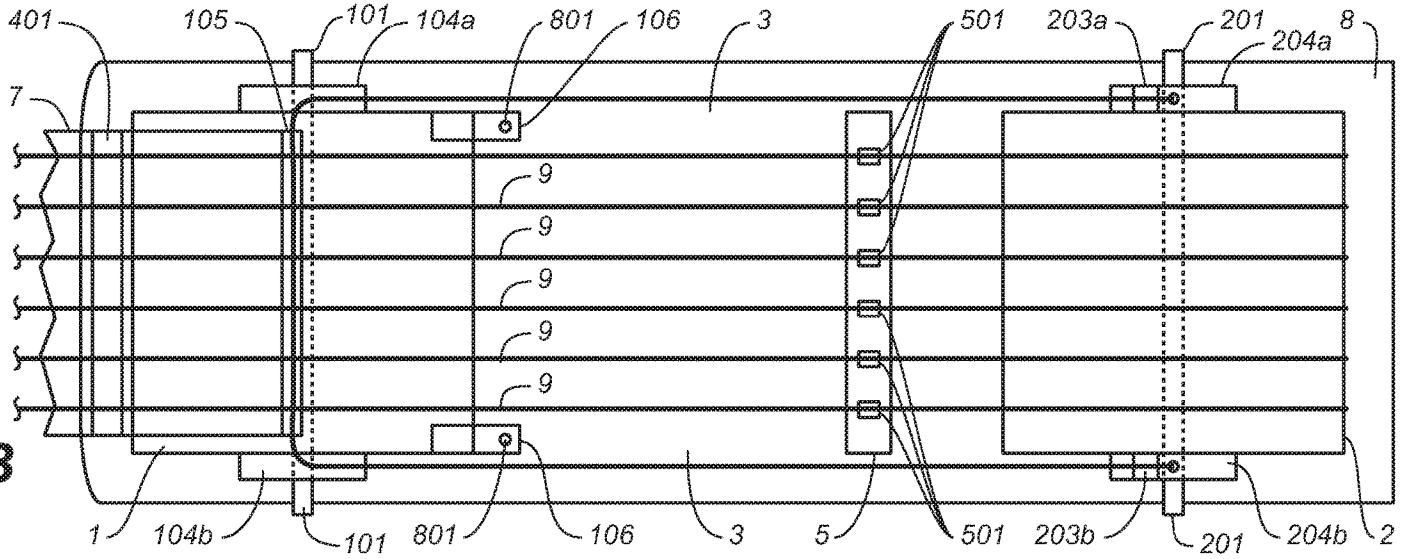

Coupling system 3 may comprise gears, motors, or other mechanisms known to a person of ordinary skill in the art. Further, it cannot interfere with the instrument's wood, sound quality, structure, performance, electronics, or playing area. As shown in FIG. 3, one embodiment for coupling system 3 includes a high strength, low stretch cable, such as one-eighth inch (⅛") braided steel cable. The cable is wrapped from anchor point 203*a* to anchor point 203*b* via the following path: under bridge cable roller 204*a*, down rigid structure 8, over neck cable roller 104*a*, through neck cable channel 105, over neck cable roller 104*b*, back down rigid structure 8, and under bridge cable roller 204*b*.

With this arrangement, the new anchor point for tension is now 'floating' on neck roller assembly 1. Thus, as the strings wrap around neck roller assembly 1, that is, as the neck moves from its unfolded position to its folded position, the tension remains constant as the cable 'un- wraps' around cable rollers 104*a* and 104*b*. Similarly, as bridge roller assembly 2 un-wraps the reservoir of string from itself, the cable 'wraps' around cable rollers 204*a* and 204*b*.

To maintain control of the relationship between neck roller assembly 1 and bridge roller assembly 2, the linear dimension of the strings must be controlled. For example, as shown and described in FIG. 9, for a high 'E' string (329.63 Hz), a 12:1 tuner requires nearly a complete turn to change the note by half a step. A half step translates to about three sixty fourths inch (3/64") of linear string length. Thus, the linear dimension of the strings must be controlled to within about one sixty fourth (1/64) of an inch. In other words, the tension of the strings in an un-folded position and the tension of the strings in a folded position may be controlled with: (1) differences in the diameters of the rollers in neck roller assembly 1 and bridge roller assembly 2; (2) differences between the ratios of the cable rollers in neck roller assembly 1 and their respective cable rollers in bridge roller assembly 2; and (3) changes to the shape of the cable rollers in either or both neck roller assembly 1 and bridge roller assembly 2 (for example, from circular to elliptical) using intermediate states of tension as the neck moves from an unfolded position to a folded position.

Figure 4:
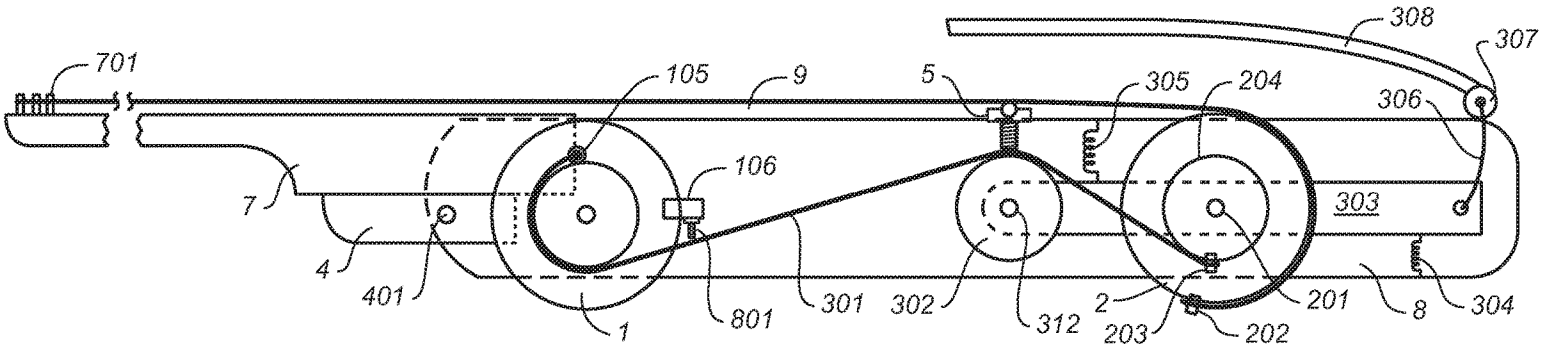
FIG. 4 is a side view of still another embodiment of the invention in the unfolded 'playing' state.

To achieve control better than (or alternative to) one sixty fourth (1/64) of an inch, intermediate coupling may be used. For example, as shown in FIG. 4, coupling system 3 may be composed of springs 304 and 305, lever 303, and rollers 302 and 312. In an alternate embodiment, the instrument may include vibrato arm assembly 350.

In FIGS. 6*a* and 6*b*, in one embodiment of the neck roller assembly 1, assembly 1 includes, in part, nested cable rollers 104*a* and 104*b*, axle 101, rods 106*a* and 106*b*, and neck conduit 105. Nested cable rollers 104*a* and 104*b*, which may be made from a hard wood (such as maple) or aluminum, may have diameters of approximately two and one quarter inches (2¼") and approximately one inch (1"), respectively. In turn, axle 101, which transverses the opening in the center of nested cable roller 104*b*, may be made from stainless steel or aluminum, and may have a diameter of approximately three eighths of an inch (⅜"). Neck conduit 105, located above nested cable roller 104*a* in this embodiment, may have a diameter of approximately one eighth inches (⅛") in this embodiment.

Nested cable roller 104*a*, nested cable roller 104*b*, axle 101 and/or neck conduit 105 may have the same length or, as shown in FIG. 6*b*, may have varying lengths. For example, axle 101 may have a greater length than nested cable rollers 104*a* and 104*b*, and nested cable roller 104*b* may have a greater length than nested cable roller 104*a*. Typically, neck conduit 105 has a length approximately equal to the width between approximately parallel rods 106*a* and 106*b*.

Figure 8:
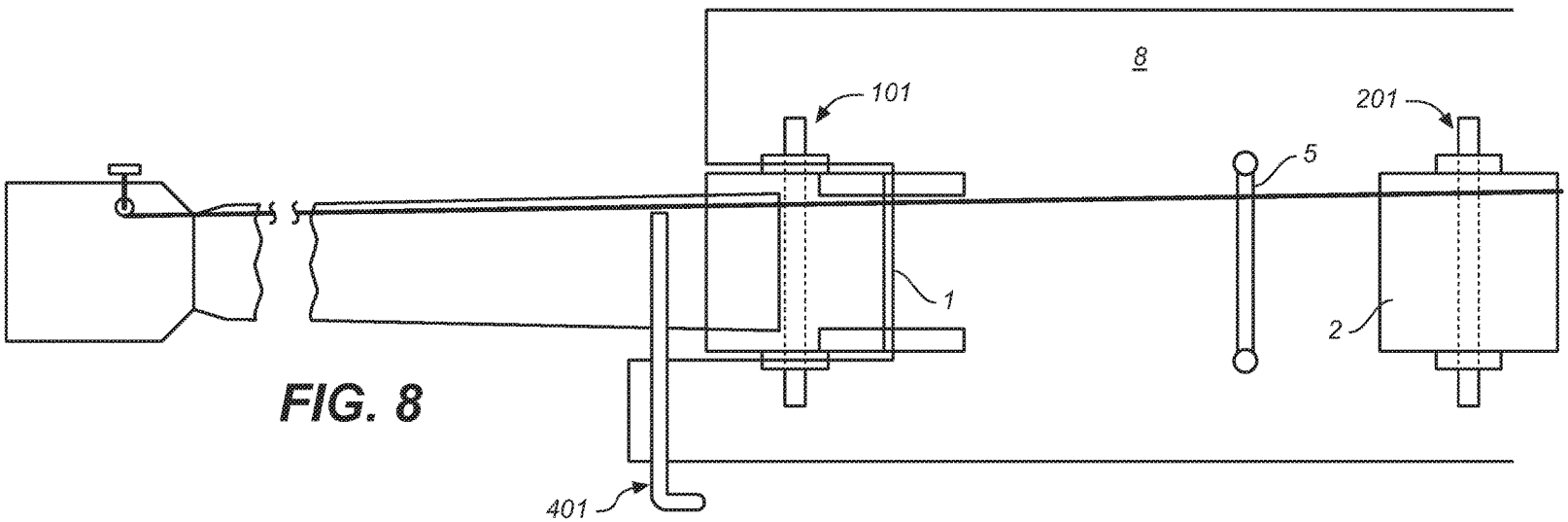
FIG. 8 is a top view of one embodiment of the invention.
Figure 5A:
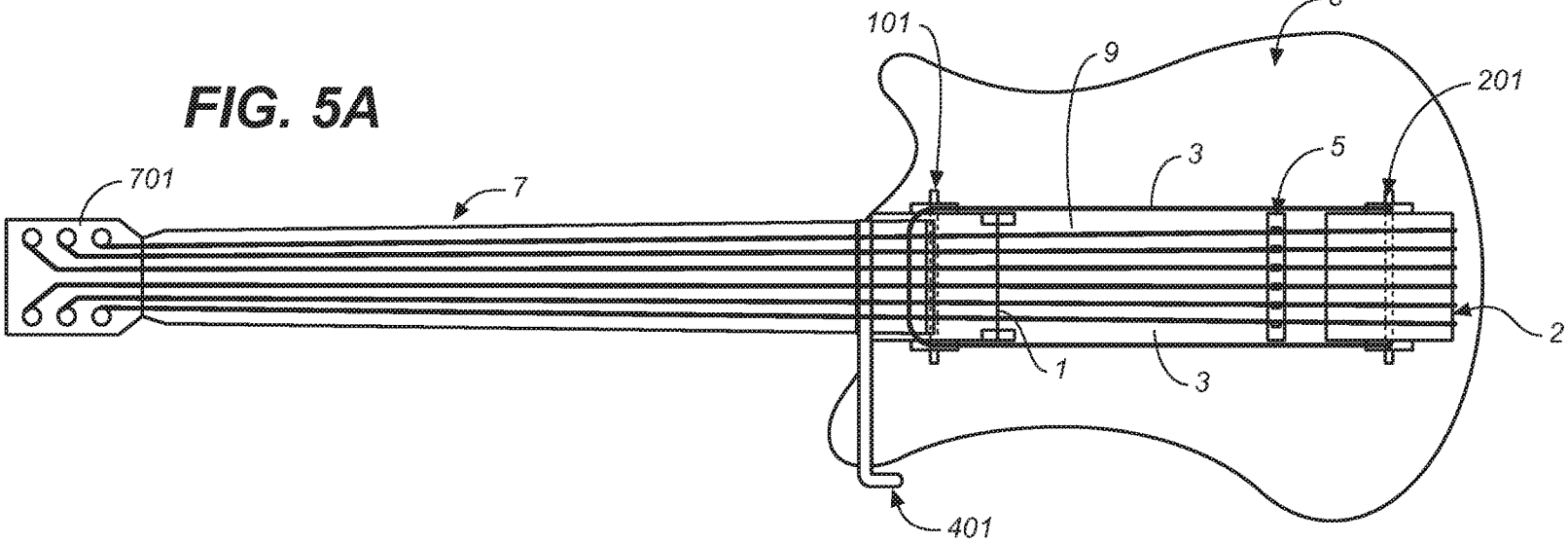
FIGS. 5*a* and 5*b* are side and top views of one embodiment of the invention in the unfolded 'playing' state.
Figure 5B:
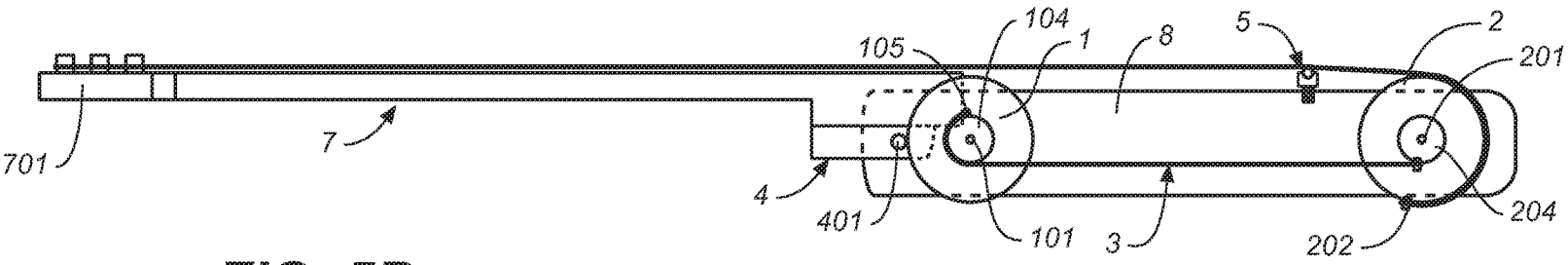

Further, as shown in FIG. 6*b*, axle 101 (along with nested cable rollers 104*a* and 104*b* and neck conduit 105) is mounted on approximately parallel rod 106. In this embodiment, rod 106 is a square steel rod with approximately one quarter inch (¼") sides. Rod 106 may be mounted to the body of the guitar with glue, screws, or a weld. As shown in FIG. 8, in one particular embodiment of the invention, the rod may be mounted to the body of the guitar such that axle 101 is mounted exactly in the middle of the thickness of the body.

Figure 9:
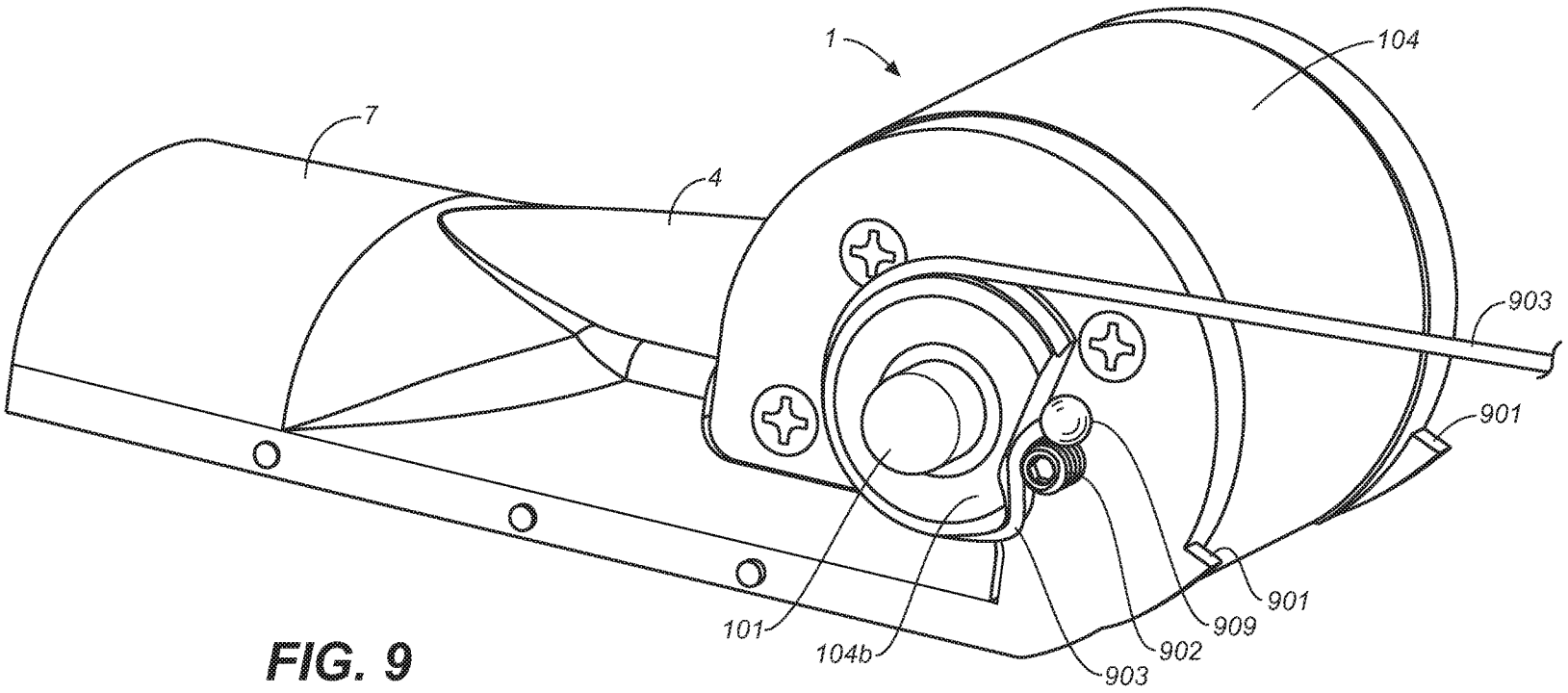
FIG. 9 is a perspective view of a different embodiment of the neck roller assembly shown in FIG. 6.

In a second embodiment as shown in FIG. 9, the individual parts of the neck roller assembly 1 can be integrated into one or more structures to form a unitary architecture or configuration. By unitary, we mean any combination of at least two of the structures included in the neck roller assembly or the bridge roller assembly of the embodiments shown in FIGS. 1-8, particularly in FIGS. 6-8, in an integrated manner to form a single structure. For example, the neck mount 4 and the front string roller 104 that covers one of the nested cable rollers 104*b* (as shown in FIG. 6A) can be combined into a single structure. Further, the neck mount 4 and neck 7 can be formed of a single piece of wood (making the neck part of the neck roller assembly). Also, the neck mount, the front string roller and the neck can be integrated into a single, unitary structure. Further, referring now to FIG. 3A and FIGS. 6A and 6B the neck angle leveler 801 and the neck roller stop 106 can be combined into a unitary neck rotation stop, 901, as shown in FIG. 9. Additionally, the cable 903 that comprises coupling system 3 and runs from bridge cable roller 204*b* to neck cable roller 104*b* through neck conduit 105 and then back to bridge cable roller 204*a* via neck cable roller 104*a* can be modified. In this modified embodiment the cable terminates at neck cable roller 104*b* and is attached thereto, eliminating the need for neck cable conduit 105 and the return of the cable to the other side of the bridge cable roller 204*a* and thereby also eliminating the need for bridge cable roller 204*a*. Cable 903 is held in position on neck cable roller 104*b* by cable anchor 902. The cable terminates at each end into cable balls 909, along with cable anchor 902 prevent the cable from moving once anchor 902 is tightened. See FIG. 9.

In FIGS. 7*a* and 7*b*, in one embodiment of the bridge roller assembly 2, assembly 2 includes, in part, nested cable rollers 204*a* and 204*b*, axle 201, the bridge string roller and bridge roller string mount 202. Nested cable rollers 204*a* and 204*b*, which may be made from a hard wood (such as maple) or aluminum, may have diameters from two and one quarter inches (2¼") to approximately one inch (1"). In turn, axle 201, which transverses the opening in the center of nested cable rollers 204*a* and 204*b*, may be made from stainless steel or aluminum, and may have a diameter of approximately three eighths inches (⅜"). Bridge roller string mount 202 may be tangential to nested cable roller 204*a*.

Nested cable roller 204*a* and nested cable roller 204*b* may have the same lengths or may have varying lengths. In turn, in this embodiment, axle 201 may have a greater length than nested cable rollers 204*a* and 204*b*. Further, as shown in FIG. 7*b*, axle 201 (along with nested cable rollers 204*a* and 204*b* and bridge roller string mount 202 is mounted as a replacement for a standard stud mount, trapeze or vibrato tailpiece within opposing bore holes in the body of the guitar.

Figure 10:
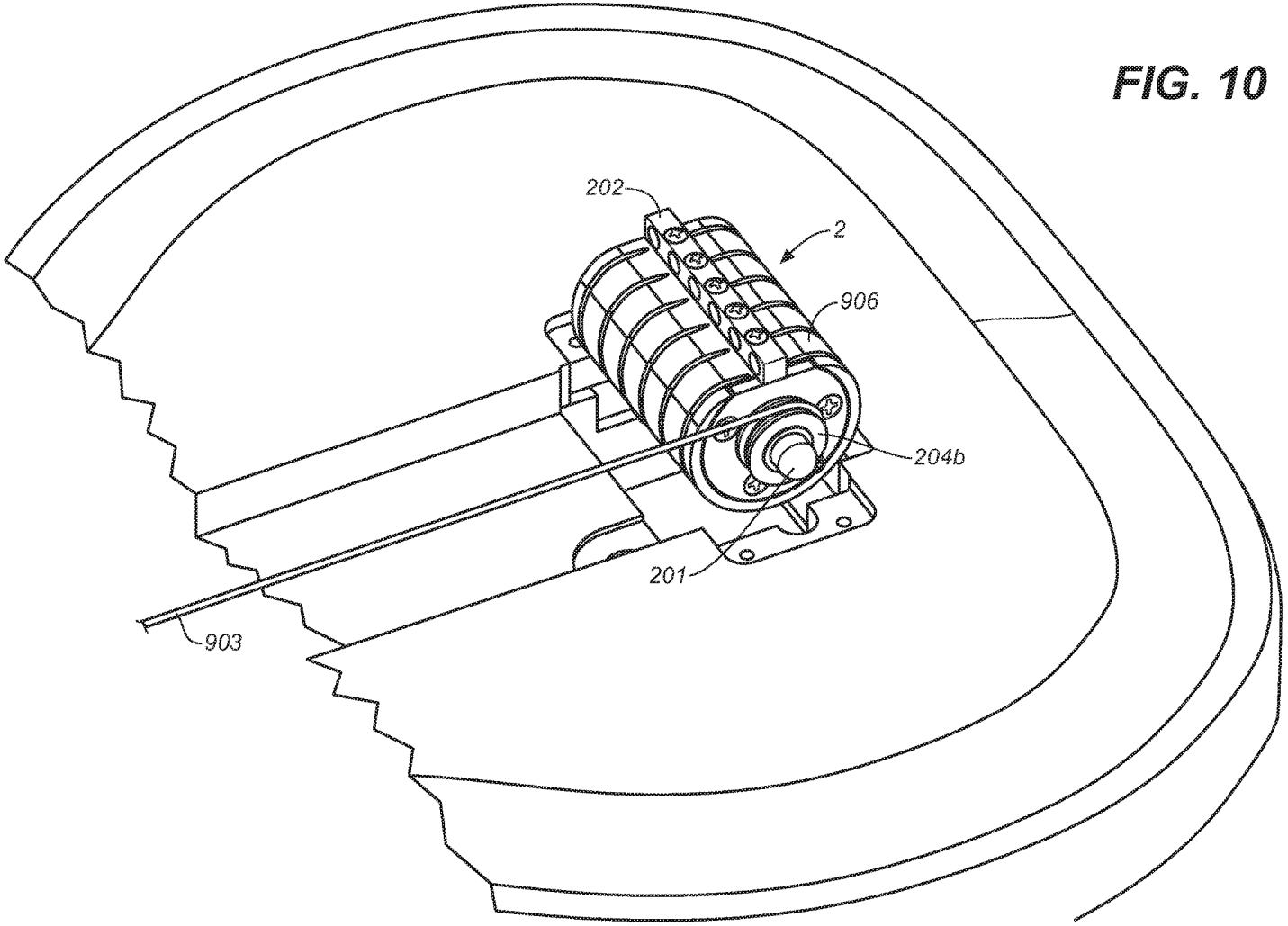
FIG. 10 is a perspective view of a different embodiment of the bridge roller assembly shown in FIG. 7.

In a second embodiment of the bridge roller assembly shown in FIG. 10, the individual parts of the assembly can be integrated into a unitary structure as was described for the neck roller assembly. For instance, bridge roller string mount 202 and the string roller 906 that forms part of the bridge roller assembly 2 can be formed as a unitary mechanism. Also, because of the elimination of the neck conduit 105 and the positioning of the cable on only one side of the neck and bridge roller assemblies, the mechanisms on the opposite side of these assemblies will become superfluous and can be eliminated.

In other embodiments of the invention, neck roller assembly 1 may be mounted in the same plane as bridge roller assembly 2, in a higher plane than bridge roller assembly 2, or in a lower plane than bridge roller assembly 2. In FIG. 8, for example, bridge roller assembly 2 is mounted one quarter inches (¼") lower than neck roller assembly 1. With such a configuration, the strings from 5 to 2 may have an approximately 10° angle.

To prevent the neck from rotating into a folded position during a performance, and as understood by a person of ordinary skill in the art, various mechanisms may be used. For example, and as shown in FIG. 4, neck roller stop 106 (a pin mechanism) prevents neck movement. Similarly, to prevent the neck from flopping onto the face of the instrument, and as understood by a person of ordinary skill in the art, various mechanisms may be used. For example, and as shown in FIG. 3, neck angle leveler 801 keeps the neck from flopping. It also allows for proper neck angle and action adjustment in the unfolded position. In the embodiment shown in FIGS. 9 and 10, the neck angle leveler 801 and the neck roller stop 106 can be combined into a unitary neck rotation stop, 901.

The invention claimed is:

1. A musical instrument, such as a guitar, comprising:

an instrument body having a front face and a rear face;

a neck roller assembly, pivotably coupled to the instrument body by means of a neck roller joint axle mounted therein for pivotal movement of the neck roller assembly between operative and folded positions, said neck roller assembly comprising a unitary structure;

an instrument neck secured at one of its ends to the neck roller assembly and having string receiving means at its other end providing a string tension anchor point on the instrument neck, wherein the instrument neck in its folded position lies opposite to the rear face of instrument body and in its operative position lies at an adjustable angle in the same plane as the front face of the instrument body;

a bridge element mounted on the instrument body and providing a string tension anchor point on the instrument body;

a bridge roller assembly, pivotably coupled to the instrument body by means of a bridge roller joint axle, to permit pivotal movement of the bridge roller assembly, said bridge roller assembly comprising a unitary structure;

a cable assembly for flexible coupling between the neck roller assembly and the bridge roller assembly, the cable assembly including a single cable coupled to one side of the neck roller assembly and the bridge roller assembly to provide proportional coupling of pivotal movement of the neck roller assembly to pivotal movement of the bridge roller assembly such that the length and tension of the at least one string is reduced when the neck roller assembly is moved between its operative position and its folded position.

2. The stringed instrument according to claim 1 wherein the rear face of the instrument body is formed with an integral neck body channel and wherein the instrument neck in its folded position lies within the integral neck body channel.

3. The stringed instrument according to claim 1 wherein the neck roller assembly comprises a neck cable roller mounted radially around the neck roller joint axle and having a conduit receiving the neck roller joint axle, a neck mount attached to the instrument neck and the rear facing side of the neck cable roller to connect the neck roller assembly to the instrument neck, a cable anchor for securing the cable onto the neck cable roller and neck rotation stop preventing over rotation of the neck.

4. The stringed instrument according to claim 3 wherein the cable assembly comprises a steel stranded cable having one end secured to the neck roller assembly by means of the cable anchor and the other end secured to the bridge roller assembly by means of a bridge cable mount.

5. The stringed instrument according to claim 3, additionally comprising at least one string secured to the bridge roller assembly at one end thereof and extending over the bridge element and secured to the string receiving means of the neck at its other end thereof.

6. The stringed instrument according to claim 5 wherein the bridge roller assembly comprises a bridge cable roller mounted radially around the bridge roller joint axle and having a conduit receiving the bridge roller joint axle, a string mount mounted circumferentially on the bridge cable roller to anchor the at least one string and a bridge cable mount mounted circumferentially on the bridge cable roller to anchor the cable assembly to bridge roller assembly.

7. The stringed instrument according to claim 6 wherein the bridge string roller is of such a size that it does not rotate more than 300 degrees in response to said pivotal movement of said neck roller assembly.

8. The stringed instrument according to claim 1 wherein the cable assembly comprises a steel stranded cable having one end attached to a bridge cable mount and the other end attached to a neck cable mount and wherein a third point on the cable is non-permanently attached to the instrument body.

9. The stringed instrument according to claim 8 wherein the cable assembly tension is adjusted with one or more cable tensioner rollers.

10. The stringed instrument according to claim 1 wherein the cable assembly according to claim 7 is not permanently affixed to either the neck cable mount or the bridge cable mount.

11. The stringed instrument according to claim 1 wherein the adjustable angle in the operative position is locked into position, arresting the pivotal movement of said neck roller assembly.

12. The stringed instrument according to claim 1, additionally comprising means for adjusting the string tension between the bridge roller assembly and the bridge.

13. The stringed instrument according to claim 12 wherein the string tension adjustment means includes one or more springs, a spring mount, and tension bar mounted to the springs and in tensile contact with the strings between the bridge roller assembly and the bridge.

14. The stringed instrument according to claim 13, additionally comprising a means for changing the position of the tension bar perpendicular to the face of the instrument body.

15. The stringed instrument according to claim 14 wherein the tension bar is free to move as the neck and the neck roller assembly are moved between their operative and folded positions.

16. A stringed instrument, such as a guitar, comprising:

an instrument body having a front face and a rear face;

a neck roller assembly, pivotably coupled to the instrument body by means of a neck roller joint axle mounted therein for pivotal movement of the neck roller assembly between operative and folded positions, said neck roller assembly comprising a unitary structure;

an instrument neck secured at one of its ends to the neck roller assembly and having string receiving means at its other end providing a string tension anchor point on the instrument neck, wherein the instrument neck in its folded position lies opposite to the rear face of instrument body and in its operative position lies at an adjustable angle in the same plane as the front face of the instrument body;

a bridge element mounted on the instrument body and providing a string tension anchor point on the instrument body;

a bridge roller assembly, pivotably coupled to the instrument body by means of a bridge roller joint axle, to permit pivotal movement of the bridge roller assembly, said bridge roller assembly comprising a unitary structure;

at least one string secured to the bridge roller assembly at one end thereof and extending over the bridge element and secured to the string receiving means of the neck at its other end thereof;

a cable assembly for flexible coupling between the neck roller assembly and the bridge roller assembly, the cable assembly including a single cable coupled to one side of the neck roller assembly and the bridge roller assembly to provide proportional coupling of pivotal movement of the neck roller assembly to pivotal movement of the bridge roller assembly such that the length and tension of the at least one string is reduced when the neck roller assembly is moved between its operative position and its folded position;

wherein the rear face of the instrument body is formed with an integral neck body channel and wherein the instrument neck in its folded position lies with the integral neck body channel.

17. The stringed instrument according to claim 16 wherein the neck roller assembly comprises a neck cable roller mounted radially around the neck roller joint axle and having a conduit receiving the neck roller joint axle, a neck mount attached to the instrument neck and the rear facing side of the neck cable roller to connect the neck roller assembly to the instrument neck, a cable anchor for securing the cable onto the neck cable roller and a neck rotation stop preventing over rotation of the neck and wherein the bridge roller assembly comprises a bridge cable roller mounted radially around the bridge roller joint axle and having a conduit receiving the bridge roller joint axle, a string mount mounted circumferentially on the bridge cable roller to anchor the at least one string and a bridge cable mount mounted circumferentially on the bridge cable roller to anchor the cable assembly to the bridge roller assembly.

18. The stringed instrument according to claim 17 wherein the cable assembly comprises a steel stranded cable having one end secured to the neck roller assembly by means of a cable anchor and the other end secured to the bridge roller assembly by means of a bridge cable mount and wherein the cable assembly tension is adjusted with one or more cable tensioner rollers.

19. The stringed instrument according to claim 18, additionally comprising means for adjusting the string tension between the bridge roller assembly and the bridge, the string tension adjustment means including one or more springs, a spring mount, and a tension bar mounted to the springs and in tensile contact with the strings between the bridge roller assembly and the bridge.

20. The stringed instrument according to claim 19, additionally comprising means for changing the position of the tension bar perpendicular to the face of the instrument body such that the tension bar is free to move as the neck and the neck roller assembly are moved between their operative and folded positions.

* * * * *